United States Patent [19]

Brown

[11] Patent Number: 4,933,516

[45] Date of Patent: Jun. 12, 1990

[54] POPPET VALVE FLOW SWITCH

[75] Inventor: Paul D. Brown, San Diego, Calif.

[73] Assignee: Sundstrand Corporation, Rockford, Ill.

[21] Appl. No.: 419,944

[22] Filed: Oct. 11, 1989

[51] Int. Cl.[5] ..... H01H 35/38

[52] U.S. Cl. ..... 200/81.9 R; 200/82 R; 251/29; 340/606

[58] Field of Search ..... 251/28, 29; 73/861.47, 73/239, 745; 340/606, 611, 626; 200/81 R, 81.9 R, 82 R; 307/118

[56] References Cited

U.S. PATENT DOCUMENTS

| | | | |
|---|---|---|---|
| 2,772,409 | 11/1956 | Reid | 200/81.9 R |
| 2,826,754 | 3/1958 | Carighan | 200/81.9 R |
| 3,444,545 | 10/1966 | Batur . | |
| 3,746,810 | 7/1973 | Parsons | 200/82 R |
| 3,890,995 | 6/1975 | Miller et al. . | |
| 3,954,249 | 5/1976 | Gratzmuller | 200/82 R |

*Primary Examiner*—Gerald P. Tolin

*Attorney, Agent, or Firm*—Antonelli, Terry, Stout & Kraus

[57] ABSTRACT

Electrical contacts (10) and (12) are bridged by surface (22) when a fluid flow rate from fluid inlet (30) to exit (34) is sufficient to displace poppet (26) against the bias of bellows (28). Bellows (28) may be sealed at opposite ends to provide an environment for contacts (10) and (12) that is isolated from the fluid.

8 Claims, 1 Drawing Sheet

POPPET VALVE FLOW SWITCH

TECHNICAL FIELD

This invention relates to the detection of fluid flow above a predetermined flow rate by use of normally open electrical contacts that are closed in response to an increasing flow rate.

BACKGROUND ART

There is a need to provide an indication which gives information concerning fluid flow in connection with engines for vehicles or auxiliary equipment on such vehicles. In some applications, there is a need to know that a predetermined flow rate either has momentarily occurred or is continuing to occur. Magnetic switches are subject to error due to an influence from a nearby motor field and secondary mechanical switches in many cases have special electrical requirements that make them unsuitable for certain aerospace activities.

DISCLOSURE OF INVENTION

An object of the invention is to provide a novel electrical switch actuator which is responsive to fluid flow, has a simplified construction and is not subject to influence by magnetic fields. The switch contacts can be located in the environment free of the fluid flowing through the housing.

Another object is to provide in a fluid flow channel a poppet valve which has a stem positioned to cause normally open electrical contacts to be closed and thereby produce a signal that represents the fact that sufficient flow was experienced to move the poppet valve to close the circuit through the contacts.

A still further object is to provide a novel transducer construction having a two piece housing with axially aligned fluid inlet and exit openings, a poppet valve mounted for axial movement in the housing and electrical switch contacts which are bridged by an electrically conductive surface that is part of the poppet valve. One housing piece supports a stem of the poppet valve whereas the other housing piece has a chamber which surrounds the valve head and a conical surface which engages the rounded surface of the valve head that faces the fluid flow inlet.

These and other objects of the invention will become more fully apparent from the claims and from the description as it proceeds in connection with the appended drawings.

BEST MODE FOR CARRYING OUT THE INVENTION

Figure 1:
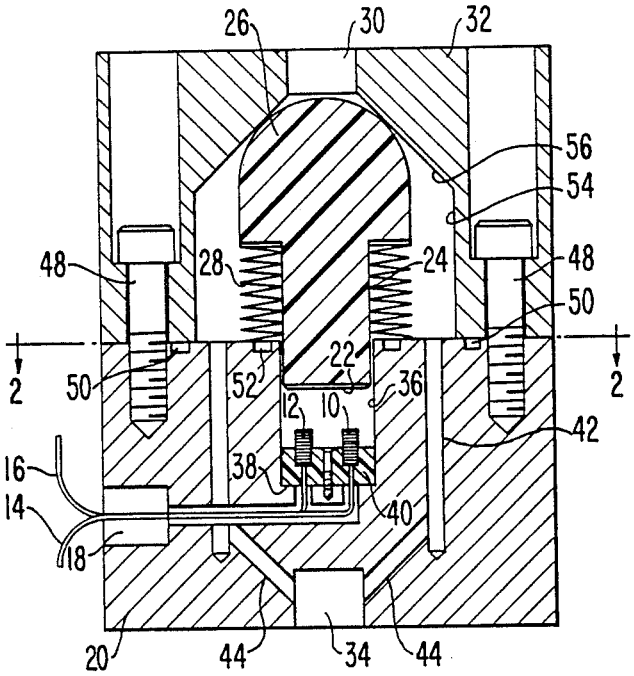
FIG. 1 is a front elevation in section of a fluid flow actuated switch embodying the present invention.
Figure 2:
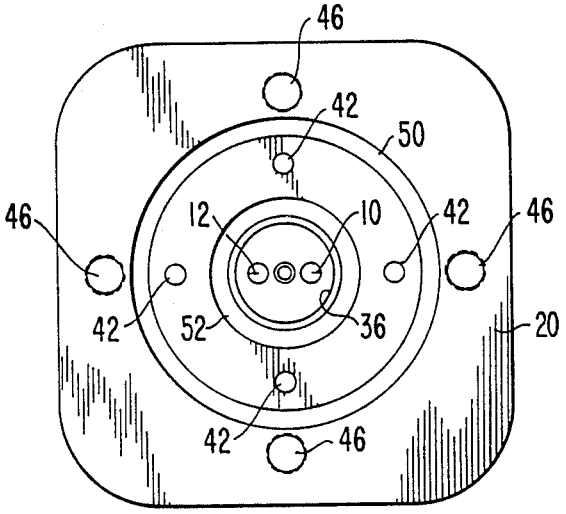
FIG. 2 is a top plan view of the lower housing piece as viewed along line 2—2 of FIG. 1.

The switch contacts 10 and 12 are connected to lead wires 14 and 16 which extend through a channel 18 that is formed in a side wall of a first housing member 20. The upper surfaces of contacts 10 and 12 are bridged by an electrically conducting lower surface 22 that is part of a stem 24 of a poppet or valve member 26. Bellows 28 urge the member 26 to its illustrated position so that the contacts 10 and 12 are normally electrically open. Fluid flow above a predetermined rate from an inlet 30 in the second housing member 32 to an exit 34 in the first housing member 20 causes valve member 26 to move downwardly and to electrically connect together the contacts 10 and 12.

The first housing member 20 has an upper surface through which a central blind bore 36 is formed which has an end wall 38. Small diameter openings communicate with channel 18. Against end wall 38, a body 40 of insulation material is held in place as by a suitable fastener. The contacts 10 and 12 may be coils of wires that are embedded at one end in insulation body 40 and connected to lead-in wires 14 and 16 as illustrated.

Housing member 20 is provided with a suitable number, four being illustrated, of flow channels 42 that extend from the upper surface and connect with exit opening 34 by slant channels 44. Four threaded bores 46 are provided to receive fasteners 48. An outer O-ring groove 50 is provided to form a sealing means radially outwardly of flow channels 42. An inner O-ring groove 52 surrounds the central bore 36 to form a sealing means between the flow channels 42 and the central bore 36 to provide in the central bore an environment for the electrical contacts 10 and 12 that is free of fluid flowing through the housing inlet 30 to the housing exit 34. A fluid seal may also be provided at the upper end of bellows 28 to surround stem 24.

The upper housing member 32 has a central opening with a cylindrical wall 54 and a frustro-conically shaped wall 56 that intersects the cylindrical wall of the inlet 30 and forms a chamber for receiving the poppet 26. Suitable bores are provided for receiving fasteners 48.

The poppet 26 is positioned with its stem 24 slidably received in the central bore 36 which extends outwardly from the upper face of lower housing member 20. Bellows 28 surround stem 24. The lower end of the bellows is in engagement with a sealing ring in inner O-ring groove 52 and the upper end of the bellows 28 is sealingly secured to the underside of the head of poppet 26. This provides a fluid seal for the valve stem 24 and the region around switch contacts 10 and 12. The poppet 26 may be formed of any suitable material including an insulation material so long as the lower surface 22, or a separate member actuated by the lower surface 22, which bridges contacts 10 and 12 is electrically conducting.

The upper surface of the valve member 26 is shown to have a shape of a hemisphere so that a line contact is made with conical wall 56 of the upper housing member 20 under no-flow conditions due to the spring force of bellows 28. When the fluid flow rate increases sufficiently to provide a force which overcomes the bellows force, poppet 26 is moved downwardly so that the contacts 10 and 12 are bridged by the electrically conductive surface 22.

The electrical circuit connected to leads 14 and 16 may be part of a control, an indicator, an alarm or other appropriate circuit which can use a signal that represents the fact that sufficient inlet flow was experienced to move the poppet stem surface 22 into engagement with the coil spring contacts 10 and 12.

Depending on the spring force provided by the bellows 28, and the dimensions of the inlet portion of the switch, various different predetermined magnitudes of flow can be set to be sensed by the switch. After passing the rounded nose of the poppet 26, the flow continues through the flow passages 42 and slant channels 44 to the exit 34.

The invention thus provides a unique flow switch which utilizes a poppet that is mounted for movement against a counteracting force, such as the bellows which provide an axial force. The force tending to move the poppet is created by the flow passing through the inlet 30 against the rounded portion of the poppet. Other equivalent arrangements may be provided and all changes and modifications which fall within the scope of the claims are intended to be covered thereby.

I claim:

1. An electrical switch actuated in response to a fluid flow comprising:

a multiple piece housing having a fluid flow passageway between inlet and exit openings in different ones of said housing pieces;

a poppet valve in said passageway including a stem mounted for axial sliding movement in of one of said housing pieces;

spring means located between an end wall of said one housing piece and said valve for biasing said valve to a normally closed position that opposes fluid flow from said inlet opening;

said valve having a surface facing the direction of fluid flow from the inlet opening including a portion which forms a passageway closure with a mating portion of a passageway wall in a second of said housing pieces;

a body of insulating material located in said one housing piece remote from said passageway; and a pair of spaced electrical contacts carried by said body and adapted to be bridged by contact with said valve stem at a predetermined fluid flow rate that is sufficient to overcome a force of said spring means.

2. The electrical switch as defined in claim 1 wherein the spring means comprises a bellows having two ends and a first means sealing against fluid leakage at a first bellows end that engages said one housing piece and a second means sealing against fluid leakage at a second bellows end that engages the poppet valve at a position surrounding said stem thereby to maintain said electrical contacts in an environment free from the fluid flowing through said housing.

3. An electrical switch comprising:

a first housing member having a central blind bore with a wire-carrying channel extending laterally of and beyond an end wall of the bore;

a body of insulating material carrying a pair of spaced electrical contacts positioned against said bore end wall with exposed electrical contacts facing toward the open end of said bore;

electrical lead-in wires extending from said electrical contacts through said wire-carrying channel to an exterior wall of said housing member;

a second housing member adapted to be secured to said first housing member to form a chamber aligned with said bore and serve as part of a fluid flow passageway between an inlet opening in said second housing member and an exit opening in said first housing member;

a valve member having a surface facing the direction of fluid flow from said inlet opening, said valve member having a portion facing a mating portion of a chamber wall for resisting fluid flow;

spring means effective to urge said valve member against said chamber wall portion at a no-flow condition of said fluid between said inlet opening and said exit opening; and said valve member having a surface positioned in said bore at a position which is spaced from said electrical contacts at said no-flow condition and which moves to a position to cause said contacts to be electrically connected together when the flow rate exceeds a predetermined value

4. An electrical switch as defined in claim 3 further having means for maintaining said electrical contacts in an environment free of the fluid passing through said housing including a fluid seal member surrounding said central bore and means for sealing said spring means at opposite ends against fluid leakage.

5. The electrical switch as defined in claim 3 wherein the spring means comprises a bellows unit which is sealed against fluid leakage at a first end that surrounds said central bore and at a second end that surrounds a portion of said valve member to thereby maintain said electrical contacts in an environment free of the fluid passing through said housing.

6. The electrical switch as defined in claim 3 wherein:

the central bore extends inwardly from a face on one side of said first housing member and the exit opening is axially aligned but not in fluid communication with said central bore;

the first housing member has a plurality of fluid flow channels having axes that are parallel to axes of said central bore and said exit opening; and said channels have an inlet portion extending inwardly from the first housing member face to be in fluid communication with said chamber and an outlet portion extending in a slantwise direction to be in fluid communication with said exit opening.

7. The electrical switch as defined in claim 6 wherein the second housing member has a face which is mounted in opposed relation to the face on the first housing member by a plurality of fasteners which are in a surrounding relation to said chamber and positioned outside a circular fluid seal member which is concentric with said central bore.

8. The electrical switch as defined in claim 6 wherein:

the second housing member has a face which is mounted in opposed relation to the face on the first housing member;

said chamber is defined by an outer cylindrical wall in said second housing member which is positioned radially outwardly of all of said fluid flow channels in said first housing member and by a conical surface which connects the inlet opening to said cylindrical wall; and said valve member has a hemispherically shaped surface adapted to engage the conical surface of said first housing member for resisting fluid flow.

* * * * *